US006705798B2

(12) United States Patent
Dubay et al.

(10) Patent No.: US 6,705,798 B2
(45) Date of Patent: Mar. 16, 2004

(54) COLD PLANER

(75) Inventors: Gregory H. Dubay, Bologna (IT); Dario Sansone, Castello d'Argile (IT); Michele Orefice, Molinella-Bologna (IT)

(73) Assignee: Bitelli S.p.A., Minerbio ( * ) Notice: Subject to any disclaimer, the term of this patent is extended or adjusted under 35 U.S.C. 154(b) by 0 days.

(21) Appl. No.: 10/183,426

(22) Filed: Jun. 28, 2002

(65) Prior Publication Data

US 2003/0016998 A1 Jan. 23, 2003

(30) Foreign Application Priority Data

Jun. 29, 2001 (EP) ..... 01115944

(51) Int. Cl.[7] ..... E01C 23/00
(52) U.S. Cl. ..... 404/84.05; 404/90; 180/209
(58) Field of Search ..... 404/83, 84.05, 404/84.1, 90, 92, 104; 299/39.4, 39.6; 180/209

(56) References Cited

U.S. PATENT DOCUMENTS

| | | | | |
|---|---|---|---|---|
| 3,188,026 A | * | 6/1965 | Perdue et al. | 244/102 R |
| 3,306,390 A | * | 2/1967 | Jamme | 180/209 |
| 3,843,274 A | * | 10/1974 | Gutman et al. | 404/91 |
| 3,971,594 A | * | 7/1976 | Wirtgen | 299/39.6 |
| 6,106,073 A | | 8/2000 | Simons et al. | |
| 6,173,512 B1 | | 1/2001 | Bitelli et al. | |

FOREIGN PATENT DOCUMENTS

| | | |
|---|---|---|
| DE | 196 31 042 A1 | 2/1998 |
| WO | WO 98/05822 | 2/1998 |

* cited by examiner

*Primary Examiner*—Robert E. Pezzuto
*Assistant Examiner*—Alexandra K. Pechhold
(74) *Attorney, Agent, or Firm*—Finnegan, Henderson, Farabow, Garrett & Dunner; Stephen L Noe

(57) ABSTRACT

A work machine having a frame, a work tool and an articulation apparatus so as to pivot at least one support wheel mounted at the frame from a projecting position to a retracted position and vice versa.

47 Claims, 5 Drawing Sheets

COLD PLANER

This application claims the benefit of priority based on European Patent Application No. 01115944.9, filed Jun. 29, 2001, which is incorporated herein by reference.

TECHNICAL FIELD

The present invention relates generally to work machines for the treatment of roadway surfaces, and more particularly to a cold planer for asphalt and concrete.

BACKGROUND ART

A prospectus entitled "Bitelli Volpe SF 100 T4M deep-cut cold planer for asphalt and concrete" describes a work machine comprising a frame which is supported by four wheels, a pair of oppositely arranged front wheels and a pair of oppositely arranged rear wheels. One of the rear wheels is adapted to raise and lower the frame relative to the respective rear wheel. Means are provided to allow for two operating positions of the one rear wheel. In a first operating position the rear wheel is mounted at the frame in what is called a projecting position, in a second operating position the rear wheel is mounted at the frame in a retracted position relative to the general outline of the frame. To allow for movement between the two operating positions a support arm is provided, which is, at its one end, pivotally connected to the frame and carries at its other end a wheel support comprising a lifting column. Typically, the rear wheel is driven by a hydraulic motor located in the hub of the rear wheel. Pressurized fluid is supplied to the hydraulic motor (and also any other hydraulic motors of other wheels which need to be driven) from an internal combustion engine mounted to the frame. To move the rear wheel from its projecting position into its retracted position the operator hydraulically lowers the frame with respect to the rear wheel. I.e. a hydraulic cylinder located inside the lifting column provides for this lowering movement. As soon as the frame or some other component fixedly mounted to the frame comes into engagement with the ground, the lifting column is lifted further by means of the hydraulic cylinder, so that the lower surface of the wheel is eventually spaced a certain distance from ground. Preferably, before the lifting of the wheel from ground has occurred, a pin locking the support arm at the frame is removed. After the wheel is spaced from the ground the operator pivots the support arm, and also simultaneously rotates the lifting column by about 120 degrees so that the running direction of the rear wheel is maintained for the two operating positions.

As is well known in the art, the possibility of positioning at least one of the rear wheels in the projecting position improves weight distribution during operation of the work machine, while the possibility of positioning the wheel in the retracted position allows the work machine to operate flush to a wall or curb. When the wheel is in the retracted position, easier movements of the work machine are possible.

However, the manual operation of displacing and locking or unlocking the pivotable wheel is somewhat uncomfortable for the operator, who is obliged to leave his seat and carry out the required operations manually.

EP 0 916 004 A1 discloses a work machine for the treatment of roadways having a rear support wheel which can be pivoted between an interior or retracted position and an exterior or projecting position by means of a guide rod gear consisting of a four-link mechanism with four vertical articulated axles and two guide rods pivotable in a horizontal plane connected to the rear support wheel. The guide rod gear pivots the rear wheel supported by a non-rotatingly locked lifting column from the exterior position to the retracted position such that the rear wheel turns in the retracted position and in the exterior position in the same direction. With this design the respective load of the work machine resting on the rear wheel is distributed to all four links of the four-link mechanism, which may result in a reduced stability and stiffness of the work machine. Also, precise couplings have to be provided which need to be inspected frequently so as to keep the wear, which might compromise good operation of the work machine, under control.

The present invention is directed to overcoming one or more of the problems or disadvantages associated with the prior art.

DISCLOSURE OF THE INVENTION

In accordance with one embodiment of the present invention there is provided a work machine, in which the automated movement to position a wheel assembly either projecting or retracted relative to the frame occurs with a greater stability in comparison with known machines, and which is less prone to wear, requires less maintenance, and is easier to manufacture than known machines. The change in position is accompanied by a corresponding rotation of the wheel assembly to keep the rotational direction of the wheel constant. This is accomplished by a work machine that includes a frame supported by a plurality of wheels or tracks, at least some of which are associated with respective lifting columns (also called inside column) adapted to raise and lower the frame relative to the respective wheels or tracks. Preferably, each of the wheels is associated with one respective lifting column. A work tool is supported by the frame, and a drive mechanism is adapted to rotate the work tool and at least one of the wheels or tracks. An articulation apparatus uses an actuator and a pivoting support arm to move one of the wheels or tracks between a projecting position and a retracted position relative to the frame, and includes a plurality of torque arms connected between the frame and the support arm to rotate the lifting column relative to the support arm in response to pivoting of the support arm.

BEST MODE FOR CARRYING OUT THE INVENTION

Figure 1:
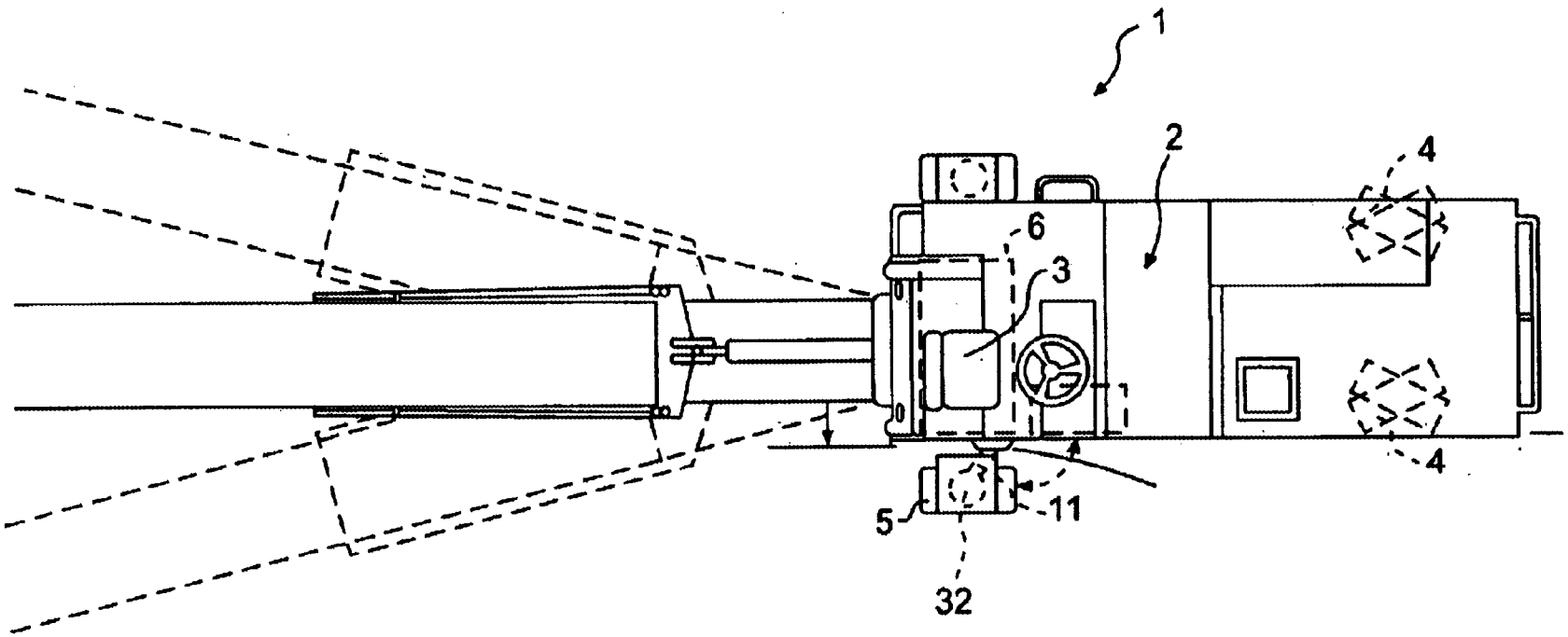
FIG. 1 is an isometric view of a work machine, i.e. a cold planer, in which the features of the present invention may be incorporated.

FIG. 1 shows a work machine, i.e. a cold planer 1 for asphalt and concrete, also called a scarifier, which may incorporate the features of the present invention. The work machine 1 comprises a frame 2 supported by a pair of front wheels 4, a pair of rear wheels 5, and an operator seat 3 for an operator O. A work tool, e.g. a cutter or milling drum 6 for removing road surface material like asphalt or concrete is supported and rotatably connected to the frame 2. A drive mechanism (not shown), for instance an internal combustion engine, is mounted inside of the work machine 1 on the frame 2 in a position behind the operator seat 3. The drive mechanism supplies the power for rotating the work tool 6 and also for the front wheels 4 and/or the rear wheels 5 resting on the surface of the road paving to be worked on. In the work machine 1 shown in FIG. 1 one of the two rear wheels 5 is adapted to be moved between a projected position (shown) and a retracted position, and vice versa. Conceivably, more than one wheel 4, 5 could be designed to be movable between the two positions.

Referring now to FIGS. 2 to 5 there is shown a portion of a work machine of the type shown in FIG. 1 which incorporates the features of the present invention therein. The work machine of the invention includes an articulation apparatus 15 (FIGS. 2 and 5) adapted to pivotally move one of the rear wheels 5 between the projecting position 60 (in FIG. 3) and the retracted position 70 (see FIG. 3) relative to a frame 2.

The articulation apparatus 15 is arranged between the frame 2 and a rear wheel support of the rear wheel 5.

Figure 4:
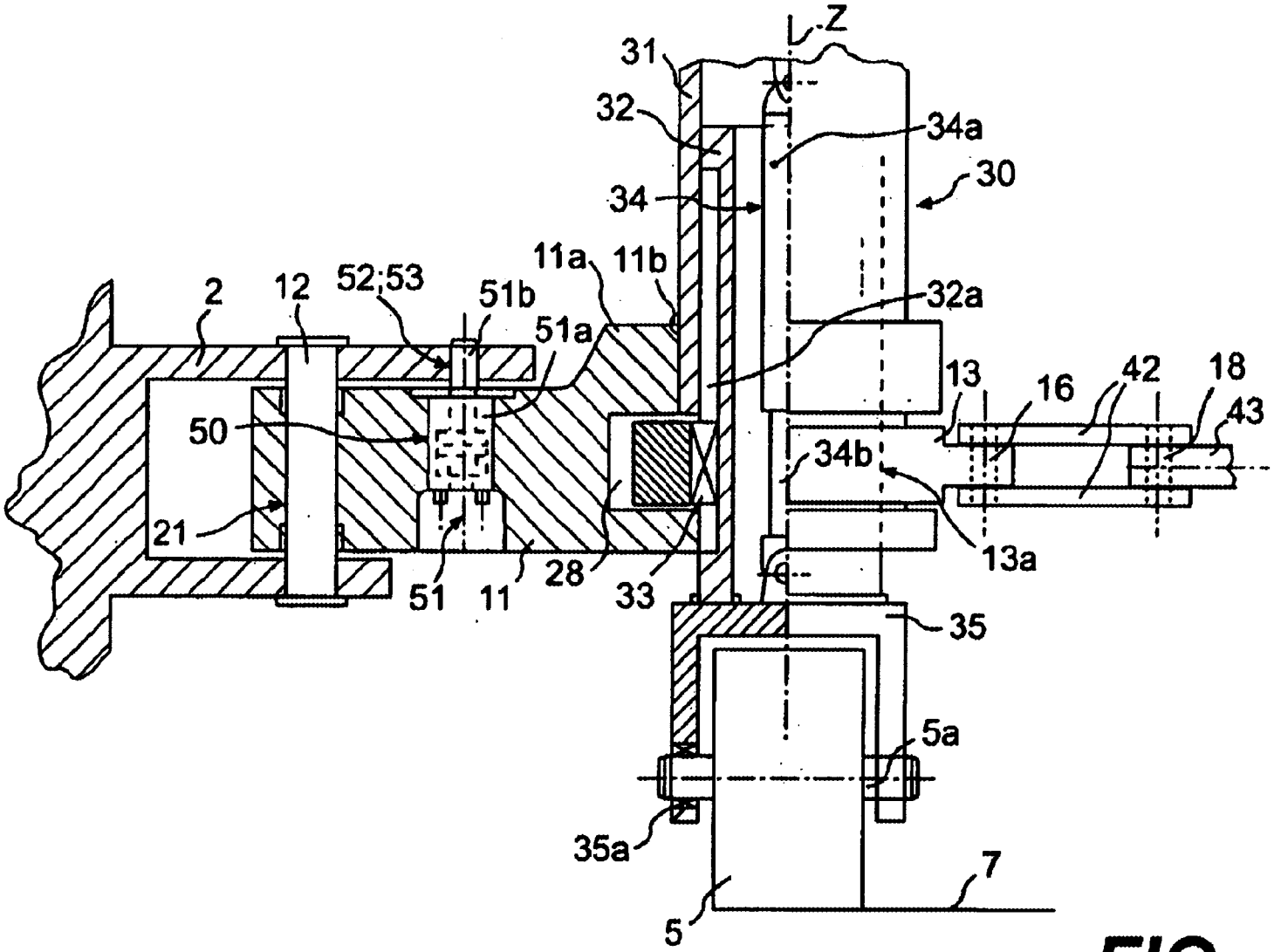
FIG. 4 is a longitudinal sectional view of the detail of FIG. 2.

As is shown in FIG. 4 the rear wheel 5 is supported by the rear wheel support comprising a U-shaped bracket 35 and, fixedly mounted thereto, a vertical lifting column (also called inner or inside column) 32. The inside column 32 is slideably mounted inside a support column (also called outside column) 30. The wheel 5 is rotatably mounted by a bearing 35*a* on the bracket 35. Preferably, as will be described below, the articulation apparatus 15 extends between the frame 2 and the inside column 32 of the rear wheel support.

The articulation apparatus 15 comprises:

a support arm 11 pivotally mounted at the frame 2;

an actuator 55 for rotating the support arm 11;

a torque arm system 4013 (FIG. 3) connected between the frame 2 and the support arm 11 in a manner sufficient to maintain the rotational direction Y of the one wheel 5 by causing the lifting column 32 to rotate relative to the support arm 11 in response to the actuator 55 pivoting the support arm 11 relative to the frame 2.

The torque arm system 4013 comprises torque arms 40 and a coupling member that, in a preferred embodiment, is in the form of a ring 13. The ring 13 is pivotally connected to one of the torque arms 40 and is further coupled to the inside column 32 thus coupling the torque arms 40 and consequently the torque arm system 4013 to the inside column 32. As is shown in FIG. 4 the support arm 11 is provided with a housing 28 forming a cavity adapted to receive the ring 13.

It is noted that the support arm 11 is the only support for connecting the rear wheel support and its inside column 32 to the frame 2. The torque arm system 4013 has no load support function. The torque arm system 4013 is only used for rotating the inside column 32 and consequently the rear wheel support so as to maintain the direction of rotation of the rear wheel the same regardless whether the rear wheel 5 is in the projected or retracted position.

Figure 3:
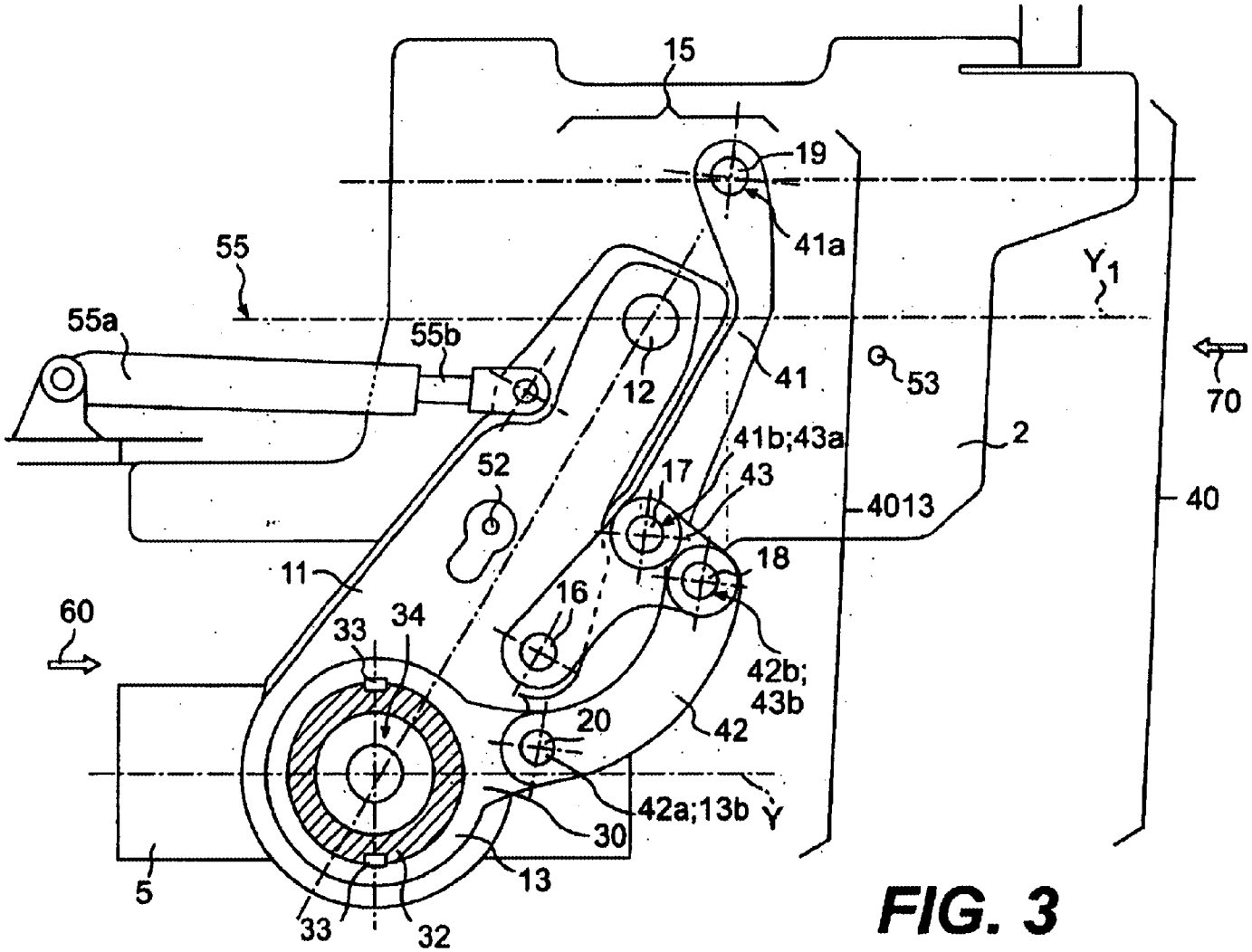
FIG. 3 shows the detail of FIG. 2 with the rear wheel arranged in a projecting position relative to the frame.
Figure 5:
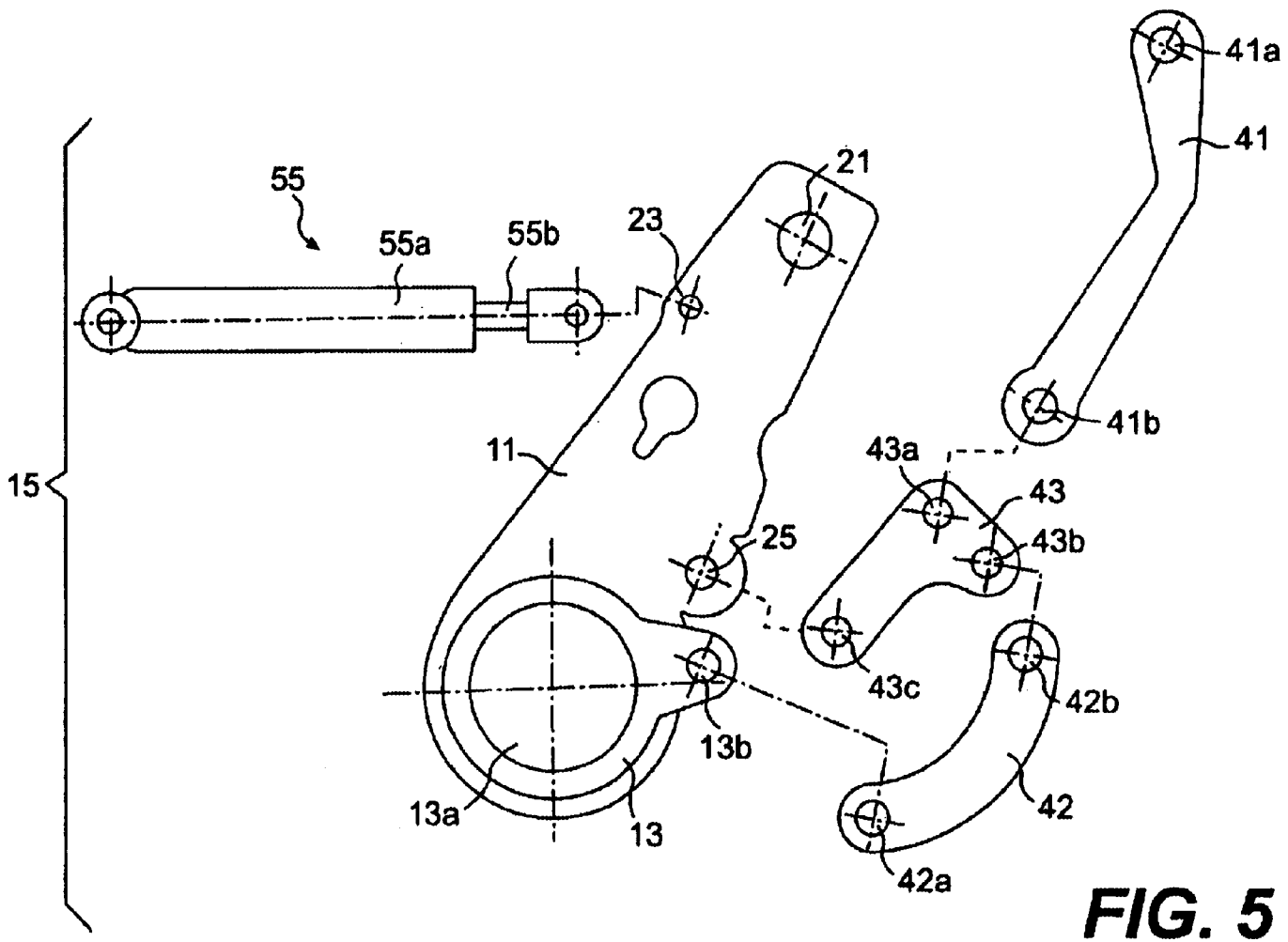
FIG. 5 is an exploded view of the detail of FIG. 2.

As to the support arm 11, one can see particularly in FIGS. 3 to 5, that this support arm 11 has a fork-shaped end 11*a* defining the housing 28 receiving the ring 13. The support arm 11 is provided with a first hole 21 for pivotally mounting the support arm 11 to the frame 2 by means of a pin 12.

The fork-shaped end 11*a* and the ring 13 are provided with a through-hole 11*b* and 13*a*, respectively. The through-hole 11*b* and the through-hole 13*a* are mutually coaxial. Through-hole 11*b* receives an outside column 30 that ends at the upper wall of the housing 28. The inside column 32 extends through the through-hole 13*a*.

As shown in FIG. 4, the outside column 30 comprises a first sleeve 31, which is coaxially fixed, for instance by means of welding within the hole 11*b*. Inside the outer column 30 is, coaxially arranged to the outer column 30 the inner column 32, which passes through the through-hole 13*a*.

A longitudinal groove 32*a* is provided in the outside of the inside column 32. The groove 32 has a certain length defining the desirable extent of movement between the inside column 32 and the outside column 30. A key 33 is fixedly mounted at an inner surface of the ring 13 and is in slideable engagement with the groove 32*a*. The key 33 and the groove 32*a* allow longitudinal relative sliding motion along a vertical axis Z between the inside column 32 and the outside column 30.

Inside the inside column 32 there is a hydraulic jack 34, the body 34*a* of which is connected to the outside column 30, while the end of a stem 34*b* of the hydraulic jack 34 is connected to the bracket 35 supporting the wheel 5. More particularly, the bracket 35 has a pair of coaxial and oppositely located holes 35*a* supporting the ends 5*a* of a pin supporting the wheel 5. The hydraulic jack 34 allows lifting and lowering, respectively, the wheel 5 in the direction Z. Thus, the height of the support arm 11 relative to the ground or pavement to be worked on can be adjusted.

Figure 2:
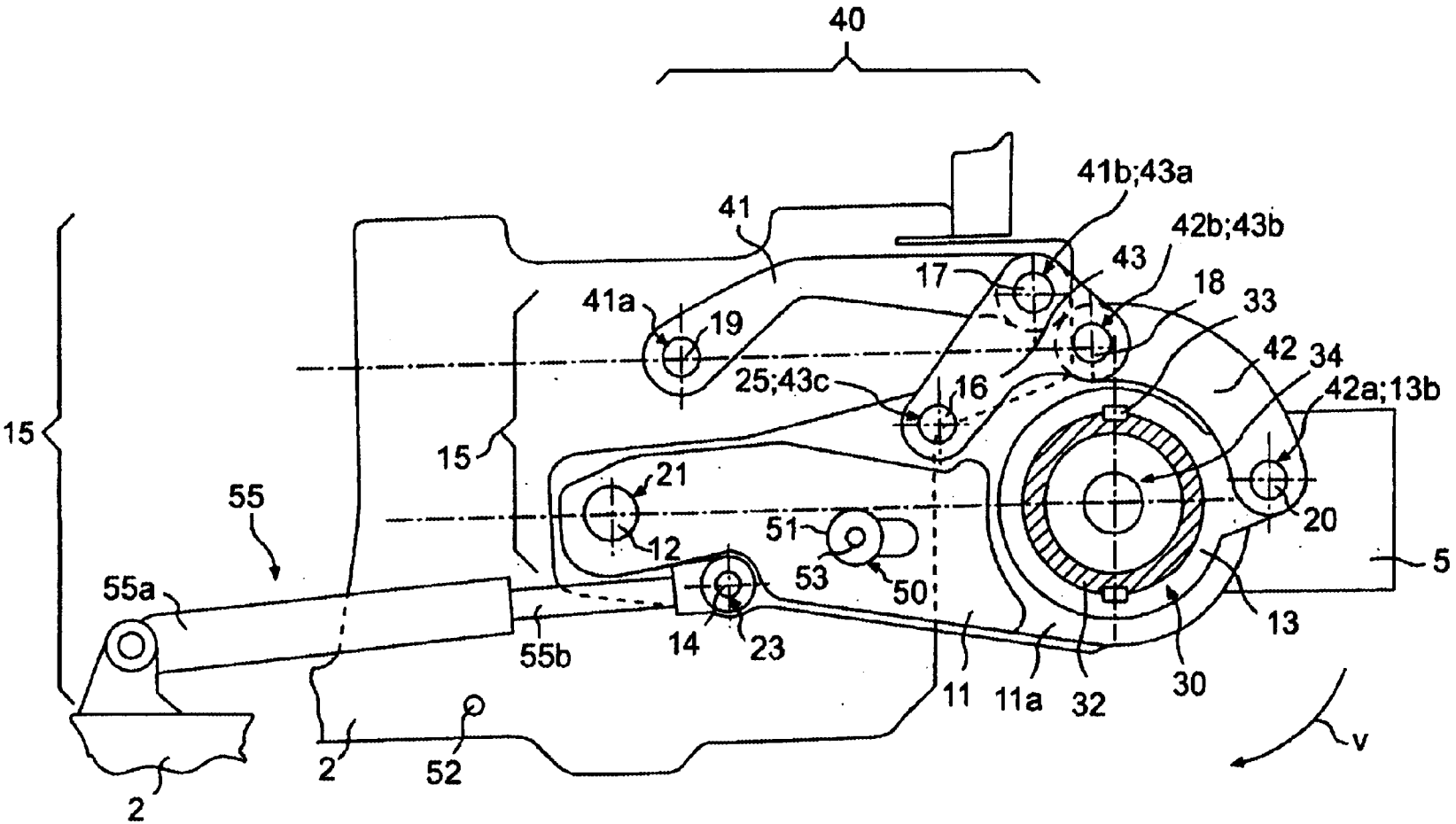
FIG. 2 is a top plan view—partially in section—of a detail of the cold planer of FIG. 1 with a rear support wheel arranged in a retracted position relative to the frame.

FIGS. 2 and 5 show that the support arm 11 has also a second hole 23 adapted to receive therein a pin 14 so as to provide a pivot connection between the actuator 55 and the support arm 11. The actuator 55 consists of a hydraulic cylinder having the body 55*a* pivotally connected to the frame 2 and a shaft 55 pivotally connected to the second hole 23.

As shown in FIG. 5 the support arm 11 and the ring 13 are provided with a third hole and a hole 13*b*, respectively, for a pivotal connection to the torque arms 40.

More particularly, the torque arms 40 comprise a first connecting rod 41 pivoted to the frame 2 and a second connecting rod 42 pivoted to the ring 13. The connecting rods 41, 42 are pivoted to a third connecting rod 43, which in turn is pivoted to the support arm 11.

The first connecting rod 41 has a first hole 41*a* adapted to receive a pin 19 pivoted to the frame 2, and a second hole 41*b* receiving a pin 17 pivoted to the third connecting rod 43; the second connecting rod 42 is provided with a first hole 42*a* receiving a pin 20 pivoted to the ring 13, and a second hole 42*b* receiving a pin 18 pivoted to the third connecting rod 43; the third connecting rod 43 has a first hole 43*a* receiving the pin 17 pivoted to the first connecting rod 41. A second hole 43*b* receiving the pin 18 is pivoted to the second connecting rod 42, and finally the third connecting rod 43 has a third hole 43*c* receiving a pin 16 pivoted to the support arm 11.

Turning again to the support arm 11 FIG. 4 shows that this arm 11 is provided also with a housing or cavity 50 within which an actuator 51 is located, which is used for blocking a rotary movement of the support arm 11 with respect to the frame 2. Indeed, a body 51*a* of the actuator 51 is coupled preferably fixedly mounted in the housing 50 provided in the support arm 11. A stem 51*b* of the actuator 51 can be inserted into holes 52, 53 provided in the frame 2 so as to block or lock the articulation apparatus 15. Blocking or locking the articulation apparatus 15 will also lock or block the wheel 5 supported by the inner column 32 in the retracted position 70 or projecting position 60 relative to the frame 2, respectively.

INDUSTRIAL APPLICABILITY

In operation, starting from the configuration shown in FIG. 2 in which the wheel 5 is arranged in the retracted position 70, retracted relative to the frame 2, pressurized oil is introduced into the actuator 55 and thus stem 55*b* is retracted, with the consequence that the support arm 11 can be rotated clockwise as shown by arrow V, until the configuration shown in FIG. 3 is reached with the wheel 5 being in its projecting position 60. The rotation of the support arm 11 is effected by the actuator 55.

In order to move from one configuration to the other, i.e. from the retracted position 70 to the projecting position 60 and vice versa, the action of the torque arm system 4013 is required to keep, during rotation of the support arm 11, the direction Y of advancement of the wheel 5 always the same and preferably parallel to the advancement direction Y1 (see FIG. 3) of the work machine 1.

When the wheel reaches the projecting position 60, fully projecting from the frame 2 as shown in FIG. 3, the stem 51*b* of the actuator 51 is inserted into the hole 52 provided in the frame 2 so as to block the wheel 5 in the external projecting position 60.

If it is desired to move the wheel 5 from the projected position 60 of FIG. 3 into the retracted position 70 of FIG. 2 it is sufficient to actuate the actuator 55 in the opposite direction so as to extend the stem 55*b*. Stability of the wheel 5 in the retracted position 70 is provided by the stem 51*b*, which is then inserted into the hole 53 provided in the frame 2.

In view of the above it is clear that the articulation apparatus 15 of the invention provides for enhanced operational reliability compared with prior art work machines. According to the present invention, the only weight or load bearing element of the articulation apparatus 15 is the support arm 11. The support arm 11 requires only one pivot point 21 at the frame 2 so as to allow a play-free or rigid rotational movement of the wheel 5 between the projecting and retracting positions, respectively. Thus, a more stable motion, less vibrations and less wear are obtained with the work machine of the invention.

It should be understood that through the use of a rotating inner column 32 together with a single support arm 11 of an articulation apparatus 15, that rotates the inner column 32 and the wheel 5 by 120 degrees as the wheel shifts from the retracted position 70 to the projecting position 60, or vice versa, a swinging motion for the wheel assembly is obtained.

Both the articulation apparatus 15 and also its torque arm system can be of any suitable design as long as the desired rotation of the inner column 32 is obtained. For instance the torque arm system could be replaced by a system not using any torque arms but sensing the angular position of the support arm 11 and accordingly rotating the support arm 11 so as to maintain the running direction of the wheel.

Also, the ring 13 could be replaced by a half ring or any other suitable coupling member.

Other aspects, objects and advantages of this invention can be obtained from a study of the drawings, disclosures, and the appended claims.

What is claimed is:

1. A work machine, comprising:

a frame supported by a plurality of wheels or tracks, at least some of which are associated with respective support and lifting columns adapted to raise and lower said frame relative to the respective wheels or tracks;

a work tool supported by said frame;

a drive mechanism adapted to rotate said work tool and at least one of said wheels or tracks; and an articulation apparatus adapted to pivotally move one of said wheels or tracks between a projecting position and a retracted position relative to said frame, said articulation apparatus comprising:

a support arm pivotally connecting said frame to the support column associated with said one wheel or track;

an actuator connected to said support arm and operable to pivot said support arm relative to said frame; and a plurality of torque arms connected between said frame and said support arm and directly maintaining the rotational direction of said one wheel or track by causing said lifting column to rotate relative to said support arm in response to said actuator pivoting said support arm relative to said frame.

2. The machine of claim 1, wherein the torque arms are connected to a coupling member which is in rotary engagement with said lifting column such that a vertical movement of the lifting column is possible.

3. The machine of claim 2, wherein said coupling member comprises a ring.

4. The machine of claim 3, wherein a longitudinally extending groove is provided along an outside of said lifting column with said ring being in engagement with said groove.

5. The machine of claim 4, wherein said ring is provided with a key adapted to be in engagement with said groove.

6. The machine of claim 2, wherein the support arm comprises a fork-shaped end providing with respect to a longitudinal axis of the respective lifting column an axially and radially extending space adapted to receive said coupling member.

7. The machine of claim 1, wherein a securing actuator is provided in the support arm adapted to lock the support arm in the projecting position and retracted position, respectively.

8. The machine of claim 7, wherein the securing actuator comprises a stem adapted to come into engagement with a hole in the frame when the wheel or track is in the projecting positions and with a hole in the frame when the wheel or track is in the retracted position.

9. A work machine comprising:

a frame supported by at least a pair of front wheels or tracks and at least a pair of rear wheels or tracks;

a milling drum supported by said frame;

a drive adapted to rotate said milling drum and at least one of said wheels or tracks;

an articulation apparatus for moving said at least one wheel or track from a projecting position to a retracted position relative to said frame and vice versa, wherein said articulation apparatus comprises:

a support arm pivotally connected to said frame and provided with a housing rotatably receiving a ring to which a vertical column supporting said wheel or track is coupled;

an actuator for rotating said support arm; and torque arms keeping constant the advancement direction of said wheel or track during rotation of said support arm.

10. The work machine of claim 9, wherein said torque arms comprise a first connecting rod pivoted to said frame and a second connecting rod pivoted to said ring, both said connecting rods being pivoted to a third connecting rod pivoted to said support arm.

11. The work machine of claim 9, wherein said support arm has a fork-shaped end defining said housing receiving said ring.

12. The work machine of claim 11, wherein said fork-shaped end has a through hole coaxial with a through hole of said ring, said through holes being adapted to receive the passage of said vertical column supporting said wheel or track.

13. The work machine of claim 10, wherein said support arm comprises:

a first hole receiving a pin pivoted to said frame;

a second hole receiving a pin pivoted to said actuator; and a third hole receiving a pin pivoted to said third connecting rod.

14. The work machine of claim 9, wherein said support arm has a second housing receiving a securing actuator to lock said support arm and said frame together.

15. The work machine of claim 14, wherein said securing actuator is a hydraulic jack having a body coupled in said second housing and a stem insertable into holes made in said frame.

16. The work machine of claim 10, wherein said third connecting rod comprises:

a first hole receiving a pin pivoted to said first connecting rod;

a second hole receiving a pin pivoted to said second connecting rod; and a third hole receiving a pin pivoted to said support arm.

17. The work machine of claim 10, wherein said first connecting rod comprises:

a first hole receiving a pin pivoted to said frame; and a second hole receiving a pin pivoted to said third connecting rod.

18. The work machine of claim 10, wherein said second connecting rod comprises:

a first hole receiving a pin pivoted to said ring; and a second hole receiving a pin pivoted to said third connecting rod.

19. The work machine of claim 12, wherein said vertical column comprises:

a first sleeve coaxial and fixed to said fork-shaped end of said support arm;

a second sleeve coaxially arranged inside said first sleeve and passing within said through hole made in said ring, said second sleeve being provided with a longitudinal groove in which a key fixed to said ring is coupled;

and at least a hydraulic jack coaxially arranged inside said second sleeve having its body connected to said first sleeve and an end of a stem connected to a shaped bracket supporting said wheel or track.

20. The work machine of claim 19, wherein said shaped bracket has a U shape in which there is a pair of coaxial and opposite holes supporting the ends of a rotation pin of said wheel or track.

21. The work machine of claim 9, wherein said actuator comprises a hydraulic jack having a body pivoted to said frame and an end of a stem pivoted to said support arm.

22. A work machine, comprising:

a frame supported by a plurality of wheels or tracks, at least some of which are associated with respective support and lifting columns adapted to raise and lower said frame relative to the respective wheels or tracks;

a work tool supported by said frame;

a drive mechanism adapted to rotate said work tool and at least one of said wheels or tracks; and an articulation apparatus adapted to pivotally move one of said wheels or tracks between a projecting position and a retracted position relative to said frame, said articulation apparatus comprising:

a support arm pivotally connected to said frame and to the support column associated with said one wheel or track;

an actuator directly connected to said support arm and operable to pivot said support arm relative to said frame; and a torque arm system connected between said frame and said support arm and said lifting column and directly maintaining the rotational direction of said one wheel or track by causing said lifting column to rotate relative to said support arm in response to said actuator pivoting said support arm relative to said frame.

23. The machine of claim 22, wherein the torque arm system comprises a plurality of torque arms and a coupling member which is in rotary engagement with said lifting column such that a vertical movement of the lifting column is possible.

24. The machine of claim 23, wherein said coupling member comprises a ring.

25. The machine of claim 24, wherein a longitudinally extending groove is provided along an outside of said lifting column with said ring being in engagement with said groove.

26. The machine of claim 25, wherein said ring is provided with a key adapted to be in engagement with said groove.

27. The machine of claim 23, wherein the plurality of torque arms are pivotally connected to said coupling member, to said frame, and to the support arm.

28. The machine of claim 23, wherein the support arm comprises a fork-shaped end providing with respect to a longitudinal axis of the lifting column an axially and radially extending space adapted to receive said coupling member.

29. The machine of claim 22, wherein a securing actuator is provided in the support arm and adapted to lock the support arm in its projecting position and retracted position, respectively.

30. The machine of claim 29, wherein the securing actuator comprises a stem adapted to come into engagement with a hole in the frame when the wheel or track is in its projected position, and with a hole in the frame when the wheel or track is in the retracted position.

31. A work machine, comprising:

a frame supported by at least a pair of front wheels or tracks and at least a pair of rear wheels or tracks, at least one of the wheels or tracks including a projectable wheel or track having a vertical centerline;

a work tool supported by said frame;

a drive mechanism adapted to rotate said work tool and at least one of said wheels or tracks; and an articulation apparatus adapted for moving said projectable wheel or track from a projecting position to a retracted position relative to said frame, wherein said articulation apparatus includes:

a support arm connected to said frame and the projectable wheel or track; the support arm including a through-hole generally coaxial with the vertical centerline of the projectable wheel or track, the projectable wheel or track configured to rotate about a vertical axis relative to the support arm;

an actuator for rotating said support arm; and torque arms rotating the projectable wheel or track about the vertical axis relative to the support arm.

32. A work machine according to claim 31, wherein the support arm includes a fork-shaped distal end portion.

33. A work machine according to claim 31, wherein the work machine includes a single support arm.

34. A work machine according to claim 31, wherein the support arm is pivotally connected to the frame, the actuator, and one of the torque arms.

35. A work machine according to claim 31, further including a securing actuator configured to lock movement of the support arm relative to the frame.

36. A work machine according to claim 32, further including a vertical column having:

a first sleeve fixedly connected to the fork-shaped distal end portion of the support arm and coaxially aligned with the through hole;

a second sleeve operably disposed within the first sleeve and the through hole; and at least one hydraulic jack having a first end and a second end, the first end connected to the first sleeve and the second end operably connected to the projectable wheel or track.

37. A work machine, comprising:

a frame supported by a plurality of wheels or tracks, at least one of which is associated with a support column and a lifting column adapted to raise and lower said frame relative to the respective wheel or track, the lifting column having a vertical axis;

a work tool supported by said frame;

a drive mechanism adapted to rotate said work tool and at least one of said wheels or tracks; and an articulation apparatus adapted to pivotally move one of said wheels or tracks between a projecting position and a retracted position relative to said frame, said articulation apparatus comprising:

a support arm pivotally connecting said frame to the support column associated with said one wheel or track, the pivotal connection having a frame pivot axis at a coupling of the support arm to the frame, and the support arm being configured to maintain a constant distance between the lifting column vertical axis and the frame pivot axis during movement of one of said wheels or tracks between the projecting position and the retracted position;

an actuator connected to said support arm and operable to pivot said support arm relative to said frame; and a plurality of torque arms connected between said frame and said support arm and directly maintaining the rotational direction of said one wheel or track by causing said lifting column to rotate relative to said support arm in response to said actuator pivoting said support arm relative to said frame.

38. A work machine according to claim 37, wherein the torque arms pivotally connect the frame, the support arm, and a coupling member operably connected to said one wheel or track.

39. A work machine according to claim 37, further including a securing actuator configured to lock the support arm in a first position and a second position.

40. A work machine according to claim 37, wherein the support column is fixedly connected to the support arm and coaxially aligned with the lifting column, the lifting column is operably disposed within the support column, and at least one hydraulic jack is operably connected to the support column and said one wheel or track.

41. A work machine according to claim 38, wherein the coupling member includes a ring having a key configured to engage a groove in the lifting column.

42. A work machine, comprising:

a frame supported by a plurality of wheels or tracks, at least one of the wheels or tracks being a projectable wheel or track, the projectable wheel or track being associated with a lifting column assembly adapted to raise and lower said frame relative to the projectable wheel or track;

a work tool supported by said frame;

a drive mechanism adapted to rotate said work tool and at least one of said plurality of wheels or tracks; and an articulation apparatus adapted to pivotally move the projectable wheel or track between a projecting position and a retracted position relative to said frame, said articulation apparatus including:

a support means for forming pivotal connections between the frame and the projectable wheel or track;

an actuator connected to said support means and operable to pivot said support means relative to said frame; and torque arm means for keeping constant the advancement direction of the projectable wheel or track during pivoting movement of the support means.

43. A work machine according to claim 42, wherein the support means is pivotally connected to the frame, the actuator, and the torque arm means.

44. A work machine according to claim 42, further including a locking means for locking movement of the support means relative to the frame.

45. A work machine according to claim 42, further including a vertical column having:

a first sleeve coaxially aligned with a through hole formed in the support means and coupled to the support means; and a positioning means for vertically moving the projectable wheel or track relative to the first sleeve.

46. A work machine according to claim 42, wherein the support means includes a single arm.

47. A work machine according to claim 42, wherein the torque arm means includes a plurality of torque arms.

* * * * *